US005393927A

United States Patent [19]

Aoki

[11] Patent Number: 5,393,927

[45] Date of Patent: Feb. 28, 1995

[54] AUTOMATIC ACCOMPANIMENT APPARATUS WITH INDEXED PATTERN SEARCHING

[75] Inventor: Eiichiro Aoki, Hamamatsu, Japan

[73] Assignee: Yamaha Corporation, Hamamatsu, Japan

[21] Appl. No.: 35,683

[22] Filed: Mar. 23, 1993

[30] Foreign Application Priority Data

Mar. 24, 1992 [JP] Japan ..... 4-097022

[51] Int. Cl.[6] ..... G10H 1/02; G10H 1/36

[52] U.S. Cl. ..... 84/631; 84/634; 84/DIG. 4

[58] Field of Search ..... 84/609-614, 84/634-638, 626-633, DIG. 4, DIG. 26

[56] References Cited

U.S. PATENT DOCUMENTS

| | | | |
|---|---|---|---|
| 4,993,307 | 2/1991 | Sakashita | 84/634 X |
| 5,177,312 | 1/1993 | Kozuki | 84/610 |
| 5,179,240 | 1/1993 | Mizuno et al. | 84/613 |
| 5,200,566 | 4/1993 | Shimaya | 84/610 X |
| 5,214,993 | 6/1993 | Konishi | 84/637 |
| 5,241,128 | 8/1993 | Imaizumi et al. | 84/634 X |

FOREIGN PATENT DOCUMENTS

| | | |
|---|---|---|
| 2232768 | 9/1990 | Japan . |
| 36515 | 1/1991 | Japan . |

*Primary Examiner*—Stanley J. Witkowski

*Attorney, Agent, or Firm*—Spensley Horn Jubas & Lubitz

[57] ABSTRACT

An automatic accompaniment apparatus is provided with a pattern memory for storing a plurality of accompaniment patterns and a reference memory for storing a plurality of references corresponding to respective accompaniment patterns, each reference being representative of a characteristic feature of each corresponding accompaniment pattern. A panel board is provided for inputting a search condition representative of a desired characteristic feature. A CPU operates for searching the references of the reference memory according to the inputted search condition so as to select from the pattern memory a particular accompaniment pattern having the desired characteristic feature specified by the search condition. A tone generator is operated for automatically performing an accompaniment according to the selected accompaniment pattern.

14 Claims, 12 Drawing Sheets

FIG.3

| | (PTN) | (PTNNAME) | (METER) | (TRPLT) | (MOOD) | (OTHER) |
|---|---|---|---|---|---|---|
| Part | Term / No. | Pattern name | Meter | Variation | Mood | Other Characteristics |
| Chord backing | 0 | DISCO | 4/4 | × | HARD,POP | |
| | 1 | 16-BEAT | 4/4 | × | HARD,POP | |
| | 2 | 8-BEAT | 4/4 | × | POP | Syncopation |
| | ⋮ | ⋮ | ⋮ | ⋮ | ⋮ | |
| | 10 | SWING | 4/4 | ○ | SOFT | |
| | ⋮ | ⋮ | ⋮ | ⋮ | ⋮ | |
| | 100 | WALTZ | 3/4 | × | SOFT | Fill-in |
| Bass | 0 ⋮ 100 | | | | | |
| Percussive rhythm | 0 ⋮ 100 | | | | | |

FIG.7A

SEARCH

METER=4/4 & TRPLT
|PTNNAME=WALTZ

FIG.7B

LST

10 SWING
100 WALTZ3

FIG.7C

Selected Pattern

100 WALTZ3

AUTOMATIC ACCOMPANIMENT APPARATUS WITH INDEXED PATTERN SEARCHING

BACKGROUND OF THE INVENTION

The present invention relates to an automatic accompaniment apparatus for automatically generating a set of chord backing tone, bass tone and percussive rhythm tone according to a given pattern based on designated chord, rhythm type and so on.

There has been known a conventional automatic accompaniment apparatus of the type having a memory for storing a plurality of accompaniment patterns which are a repetitive musical note pattern having one or two measure lengthl. A player designates a code number of a desired pattern to select the same for use in the automatic accompaniment. However, the mere code number is not descriptive and is therefore not indicative of feature of patterns. Thus, it is difficult to quickly and readily select a desired accompaniment pattern.

SUMMARY OF THE INVENTION

In view of the above noted drawback of the prior art, an object of the invention is to provide an automatic accompaniment apparatus effective to enable a player to quickly and readily select a desired accompaniment pattern. According to a first aspect of the invention, the automatic accompaniment apparatus comprises pattern memory means for storing a plurality of accompaniment patterns, reference memory means for storing a plurality of references corresponding to respective accompaniment patterns, each reference being representative of a characteristic feature of each corresponding accompaniment pattern, input means for inputting a search condition representative of a desired characteristic feature, searching means for searching the references of the reference memory means according to the inputted search condition so as to select from the pattern memory means a particular accompaniment pattern having the desired characteristic feature specified by the search condition, and performing means for automatically performing an accompaniment according to the selected accompaniment pattern.

According to a second aspect of the invention, the automatic accompaniment apparatus comprises pattern memory means for storing a plurality of accompaniment patterns which are grouped into several parts, reference memory means for storing a characteristic feature as a reference to each of the accompaniment patterns in corresponding manner, designating means for designating selectively respective one of the several parts; input means for inputting a proposed characteristic feature as a search condition for each designated part; searching means for searching the reference memory means according to the inputted search condition so as to select a particular accompaniment pattern which satisfies the proposed characteristic feature, and performing means for reading out a set of the selected accompaniment patterns from the respective parts of the pattern memory means so as to effect an automatic accompaniment which is an ensemble of the selected accompaniment patterns.

BRIEF DESCRIPTION OF THE DRAWINGS

FIG. 3 is an explanatory diagram showing contents stored in a pattern reference memory.

FIG. 7A–C is an illustrative diagram showing a displayed information of a display unit provided on the electronic musical instrument.

DETAILED DESCRIPTION OF EMBODIMENTS

Figure 1:
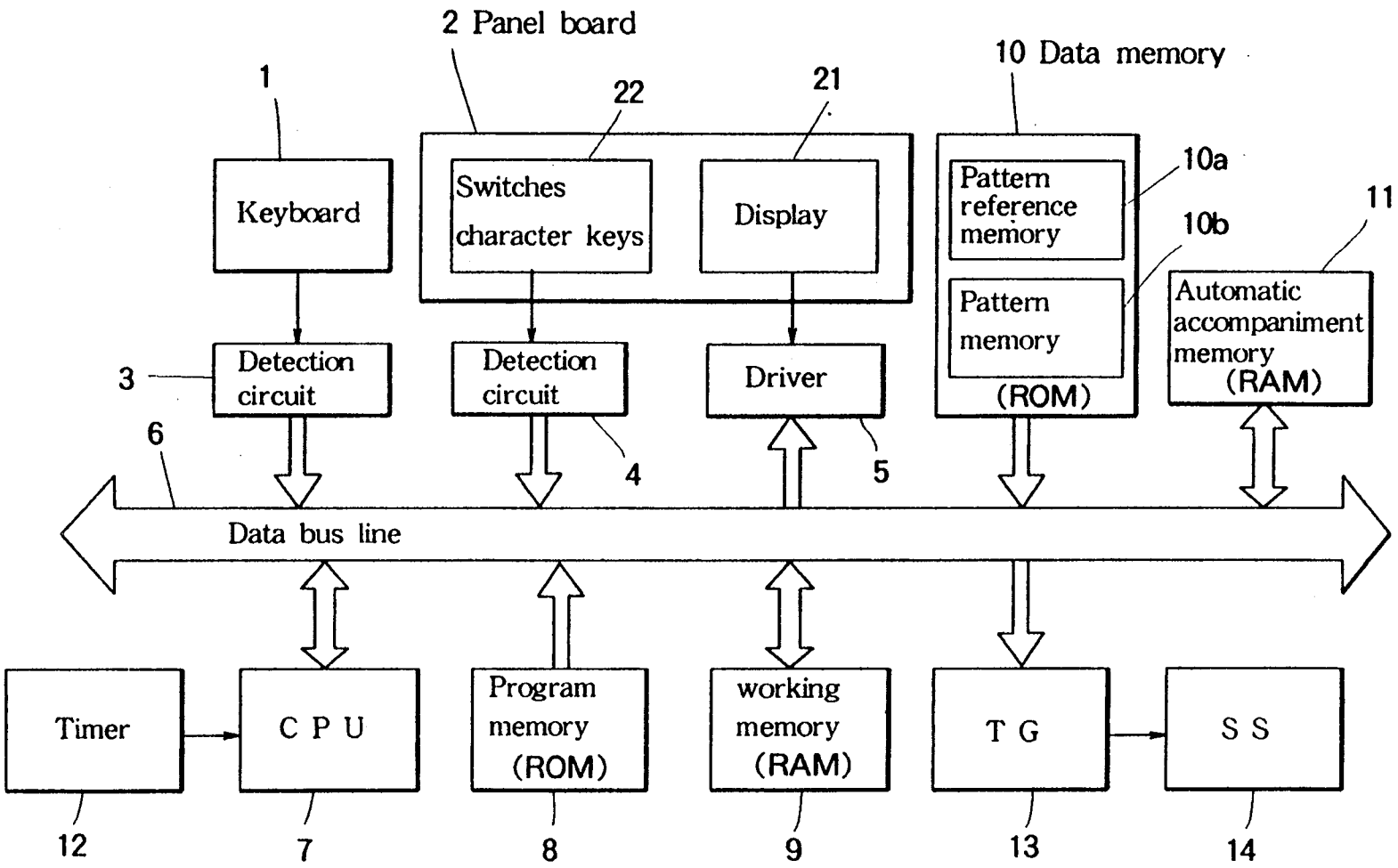
FIG. 1 is a block diagram showing an overall construction of one embodiment of the electronic musical instrument according to the invention.

Hereinafter, an embodiment of the invention will be described in conjunction with the drawings. FIG. 1 is a block diagram showing overall construction of an electronic musical instrument having an inventive automatic accompaniment apparatus. In the figure, a keyboard 1 is connected through a data bus line 6 to a central processing unit (CPU) 7 by means of a detection circuit 3 which detects key depression/release so as to feed to the CPU 7, key signals such as a key-on signal and a key code signal, representative of the key depression/release state. A panel board 2 is connected to the data bus line 6 through another detection circuit 4 and a driver 5. The panel board 2 is provided with a switch set 22 of various switches and character keys, and a display 21. The detection circuit 4 detects operation states of the various switches and character keys for inputting corresponding detection signals into the CPU 7. The driver 5 drives the display 2 1 according to display data fed from the CPU 7. A timer 12 is connected to the CPU 7 for supplying thereto a clock signal. Further, the CPU 7 interconnects through the bus line 6 various parts including a program memory 8, working memory 9, data memory 10, automatic accompaniment memory 11, and tone generator (TG) 13. The tone generator 13 is connected to a sound system (SS) 14 composed of a D/A converter, amplifier, speaker and so on. The CPU 7 carries out various processes according to the key depression/release of the keyboard 1 and according to the operation of the switches and character keys on the panel board 2. More specifically, the CPU 7 executes various process routines shown in FIGS. 4–6 and FIGS. 8–12 according to programs stored in the program memory 8, thereby outputting a control signal effective to control the tone generator 13, which can generate musical tones through the sound system 14.

The program memory 8 is of ROM type for storing the programs effective to operate the CPU 7. The data memory 10 is also of ROM type for storing data regarding accompaniment patterns. The data memory 10 is divided into a pattern reference memory **10*a* and a pattern memory 10*b*. The pattern memory 10*b* stores 101 kinds of accompaniment patterns for each of chord backing part, bass part and rhythm part. The pattern reference memory 10*a* stores references or indexes of the accompaniment patterns as shown in FIG. 3, including pattern number (PTN), pattern name (PTNNAME), pattern time meter (METER), pattern mood (MOOD), pattern variation (TRPLT) indicative of triplet pattern and, other pattern characteristics (OTHER). These terms represent various aspects of characteristic feature of each accompaniment pattern. For example, the pattern mood (MOOD) represents one aspect of characteristic feature in terms of hard pattern (HARD), soft pattern (SOFT) and pop pattern (POP). Other pattern characteristics (OTHER) may include syncopation, fill-in and so on. The pattern name (PTNNAME) expresses concisely a distinctive feature of each pattern in terms of disco (DISCO), 16-beat (16-BEAT), swing (SWING), waltz (WALTZ) and so on. Similar pattern references are stored with respect to the bass part and percussive rhythm part. However, the respective parts may have different number of patterns in modification. The pattern memory 10***b* memorizes data of accompaniment patterns corresponding to the pattern numbers (PTN) in each part. The working memory 9 is of RAM type for temporarily reserves various intermediate data during the course of operation by the CPU 7. The automatic accompaniment memory 11 is of also RAM type for registering accompaniment patterns for use during the course of effecting the automatic accompaniment.

Figure 2:
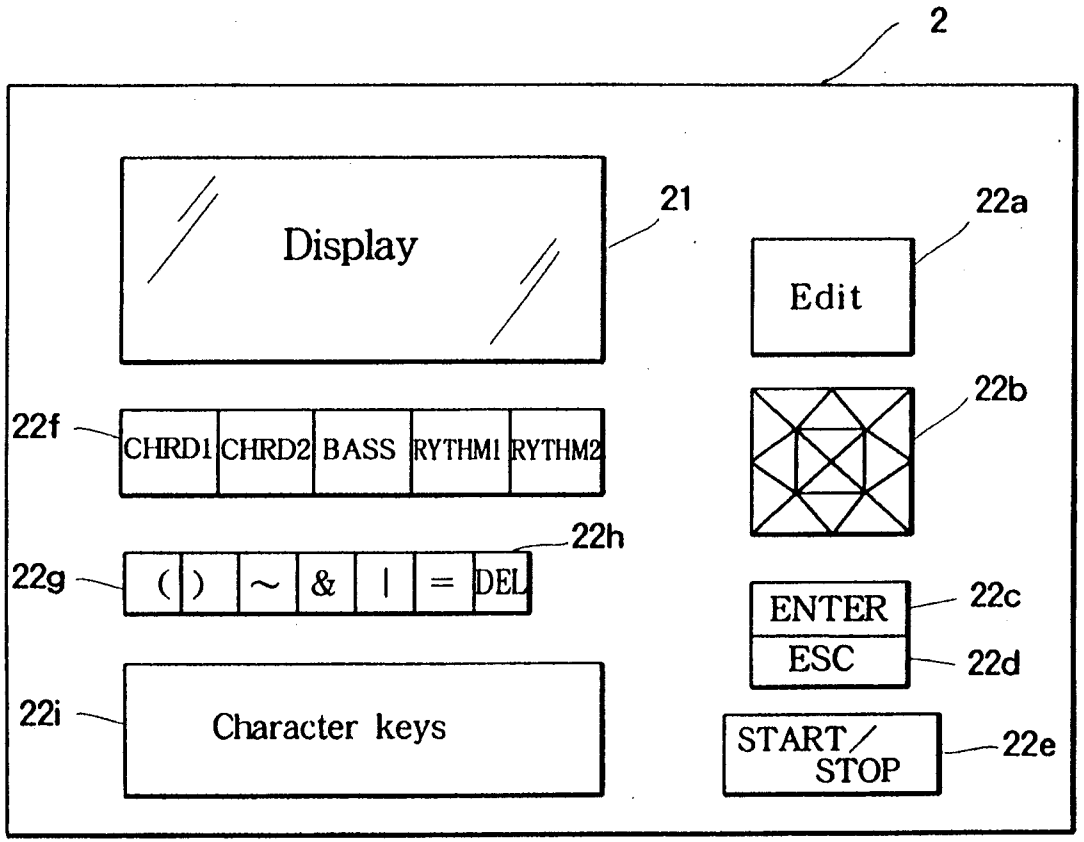
FIG. 2 is a plan view of a panel board provided on the electronic musical instrument.

FIG. 2 is a plan view showing exemplified arrangement of the panel board 2. The panel board 2 is provided with the display 21 together with various switches including an edit switch 22*a*, cursor switch 22*b*, enter switch (ENTER) 22*c*, escape switch (ESC) 22*d*, start/stop switch (START/STOP) 22*e*, part designating switches 22*f*, logic symbol switches 22*g*, delete switch (DEL) 22*h* and character keys 22*i*. The part designating switches 22*f* includes switches CHRD1, CHRD2 corresponding to the chord backing part, switch BASS corresponding to the bass part, and switches RYTHM1, RYTHM2 corresponding to the percussive rhythm part. These part designating switches 22*f* are operated to selectively designate a corresponding part in which a particular accompaniment pattern is individually selected and set. In this embodiment, a pair of accompaniment patterns can be concurrently set for each of the chord backing part and the rhythm part. The logic symbol switches 22*g* correspond to various logic symbols "(","(")", "~", "&", "|" and "=". The symbols "(","(")" and "=" have the same meanings as in ordinary arithmetic formula. The operation symbol "~" means logical inversion, the operation symbol "&" means logical product, and the operation symbol "|" means logical addition. These symbol switches are operated to input a desired logical formula, for example, (TRPLT|METER=$\frac{3}{4}$)&HARD" which means a proposed searching condition representing a desired pattern characteristic feature as "triplet or $\frac{3}{4}$ time meter and hard mood". All of the above noted switches 22*a*–22*h* are of self-reset type in this embodiment.

Figure 4:
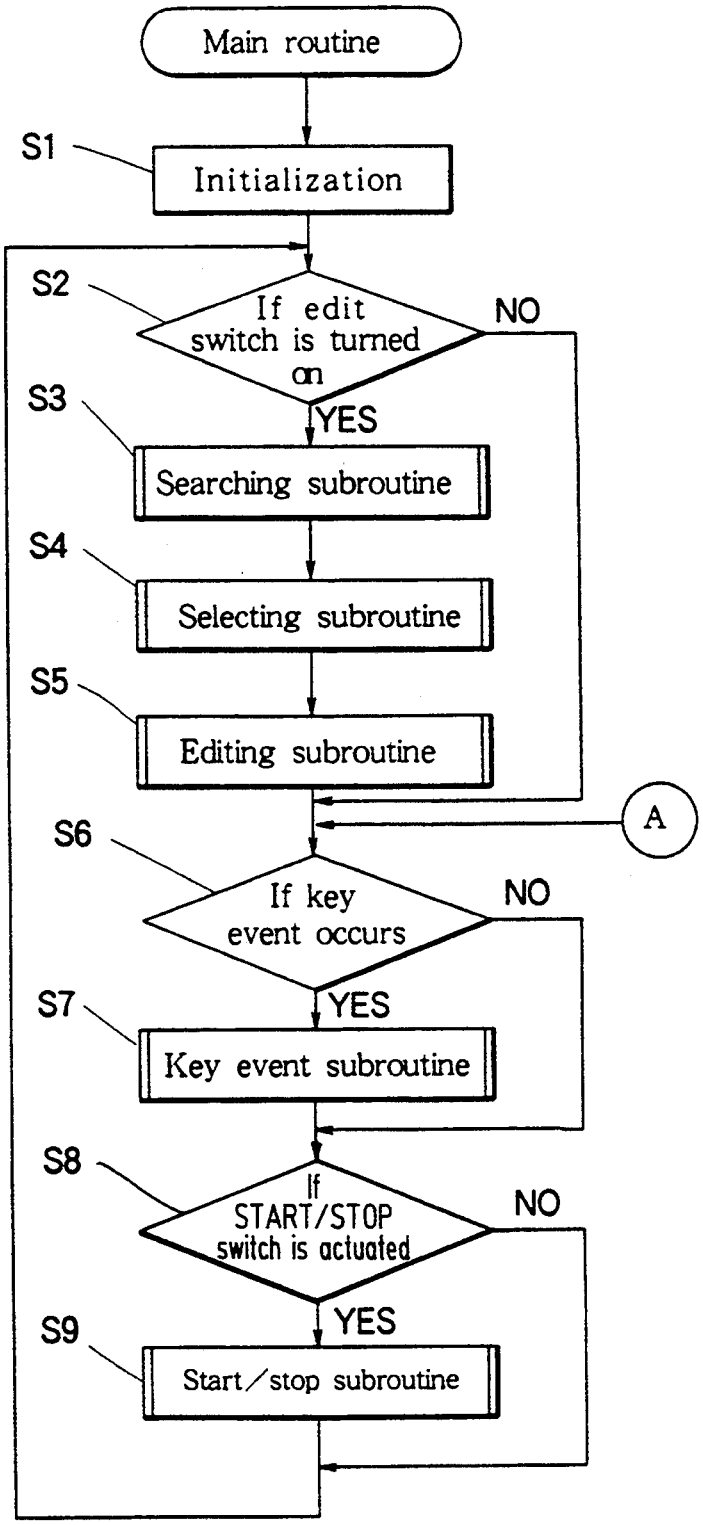
FIG. 4 is a flowchart showing a main routine process executed by a CPU provided in the electronic musical instrument.
Figure 5:
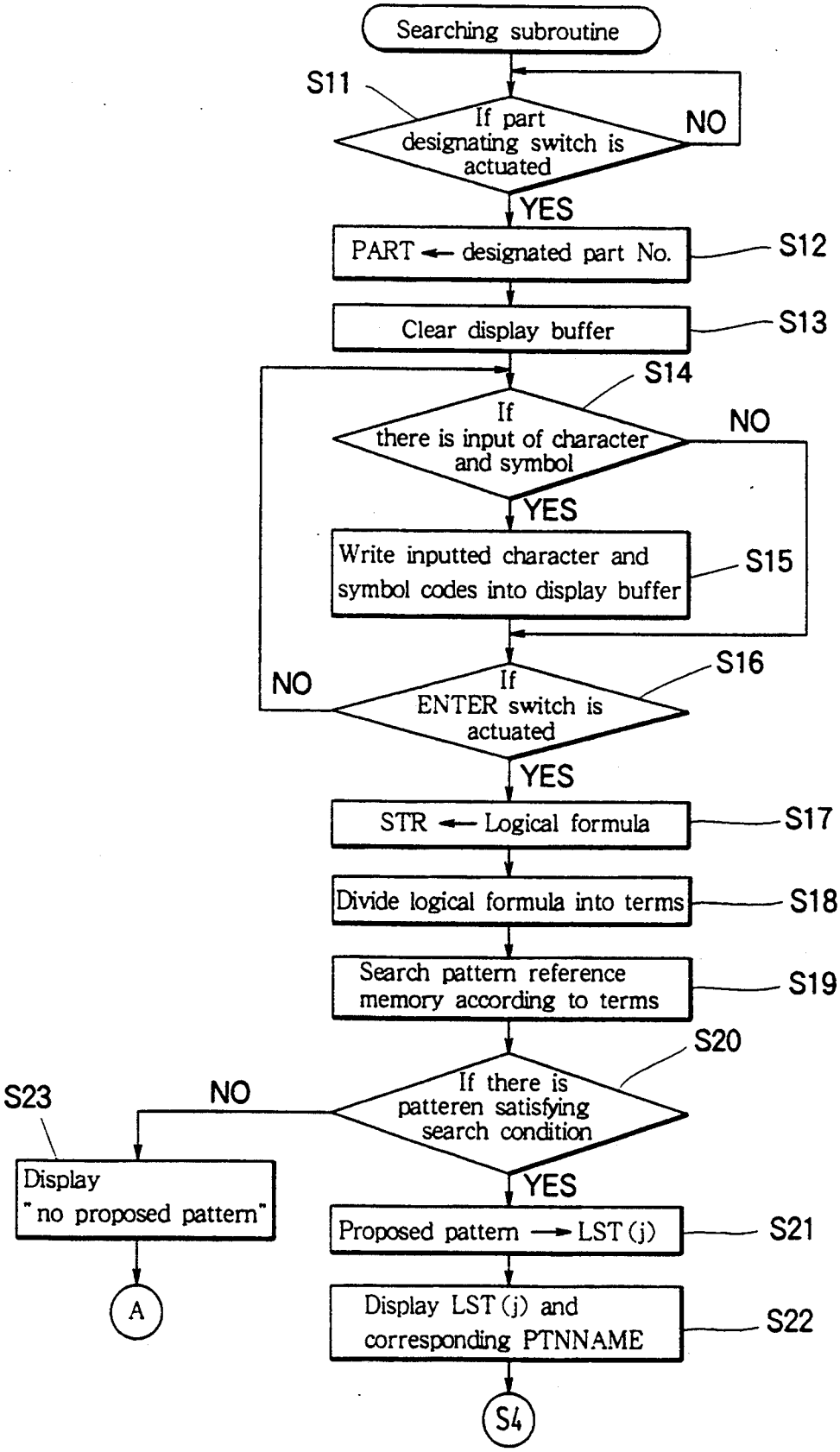
FIG. 5 is a flowchart showing a searching subroutine.

Referring next to FIGS. 4–12, description is given for processings executed by the CPU 7. FIG. 4 is a flowchart of a main routine. Firstly, Step S1 is undertaken to initialize various parameters. Then, in Step S2, check is made as to if the edit switch 22*a* of the panel board 2 is turned on. If the check result is NO, processing jumps to Step S6. If the check result shows YES, subsequent Step S3 is undertaken to execute searching subroutine, detail of which is shown in FIG. 5. Further, Step S4 is undertaken to execute selecting subroutine (FIG. 6), and Step S5 is undertaken to execute editing subroutine (FIG. 8), thereby proceeding to Step S6. By sequence of Steps S3, S4 and S5, a proposed pattern is searched with reference to inputted characteristic features so as to determine a certain pattern which is to be reproduced during the course of automatic accompaniment.

In Step S6, check is made as to if there is a key event on the keyboard 1. When the check result shows NO, processing advances to Step S8. When the check result shows YES, Step S7 is undertaken to execute key event subroutine (FIG. 9), thereby proceeding to Step S8. In the key event subroutine, either of sounding/silencing operation and chord detecting operation is carried out dependently on a key region of newly depressed or released keys. In Step S8, check is made as to if the START/STOP switch 22*e* is actuated. In case that the check result shows NO, processing returns to Step S2. In case that the check result shows YES, Step S9 is undertaken to execute start/stop subroutine (FIG. 10), thereby returning to Step S2. The start/stop subroutine effects either of setting process of an address pointer indicating a start address of the automatic accompaniment memory 11, or silencing process.

Referring to FIG. 5 which shows a detailed flowchart of the searching subroutine executed in Step S3 of the FIG. 4 main routine, Step S11 is a waiting process for watching when the part designating switch 22*f* (FIG. 2) is actuated. Subsequent Step S12 is undertaken when the part designating switch 22*f* is turned on. As noted before, the part designating switches 22*f* include switches CHRD 1, CHRD2 corresponding to the chord backing part, switch BASS corresponding to the bass part, and switches RYTHM 1, RYTHM2 corresponding to the percussive rhythm part. These switches are assigned with part numbers 0–4 in the above listed order. For example, the switch CHRD 1 is assigned part No. 0, and the switch RYTHM2 is assigned part No. 4. In Step S12, a part number corresponding to the activated part designating switch is loaded into a register PART (hereinafter, content of any register will be denoted by the same label). PART indicates the designated part involved in the searching and following processes. Then, Step S13 is undertaken to clear a buffer which registers displayed information of the display 21. In next Step S14, check is made as to if there is any input operation by the remaining switches, including input operation of characters and/or logic symbols by means of the character keys 22*i*, logic symbol switches 22*g* and cursor switch 22*b*, and delete operation of characters and/or logic symbols by means of the delete switch 22*h*. In case that the check result is NO, processing jumps to Step S16. On the other hand that the check result is YES, corresponding character and symbol codes are written into or erased from a certain location of the display buffer, designated by the cursor switch. The content of the buffer is displayed on the display 21. By the above sequence of operation, a desired search condition is inputted and indicated on the display, for example, as shown in FIG. 7A, "4/4 meter and triplet or pattern name is WALTZ". In Step S16, check is made as to if the enter switch (ENTER) 22*c* is actuated. In case that the check result shows NO, processing returns to Step S14. On the other hand that the check result shows YES, processing proceeds to Step S17. The search condition inputted by Steps S14, S15 is confirmed and entered by the actuation of switch ENTER.

Subsequent Step S17 is undertaken to transfer the contents of the buffer, i.e., the inputted search condition to another memory area STR. In next Step S18, the search condition in terms of logical formula is divided into appropriate terms according to functions of the involved logic symbols "(","(")", "~", "&" and "|". Then, in Step S19, the pattern reference memory 10*a* is searched using the divided terms in the order of logical priority to find out a pattern number PTN which satisfies the search condition. Then, check is made in Step S20 as to if there exists a pattern which meets the search condition. In case that the check result shows NO, Step S23 is undertaken to indicate "no proposed pattern" on the display 21, thereafter returning to Step S6 of the FIG. 4 main routine. On the other hand that the check result of Step S20 shows YES, Step S21 is undertaken to identify all of the searched pattern numbers PTN as proposed pattern numbers LST(j) where j takes "0 " to "number of searched patterns−1 ". Then, Step S22 is undertaken to indicate LST(j) and corresponding pattern names PTNNAME on the display, for example, as shown in FIG. 7B where two proposed patterns are listed. By the above searching subroutine of FIG. 5, there are searched pattern numbers PTN and pattern names PTNNAME which satisfy the inputted search condition, and the searched results are listed on the display 2 as "proposed patterns".

Figure 6:
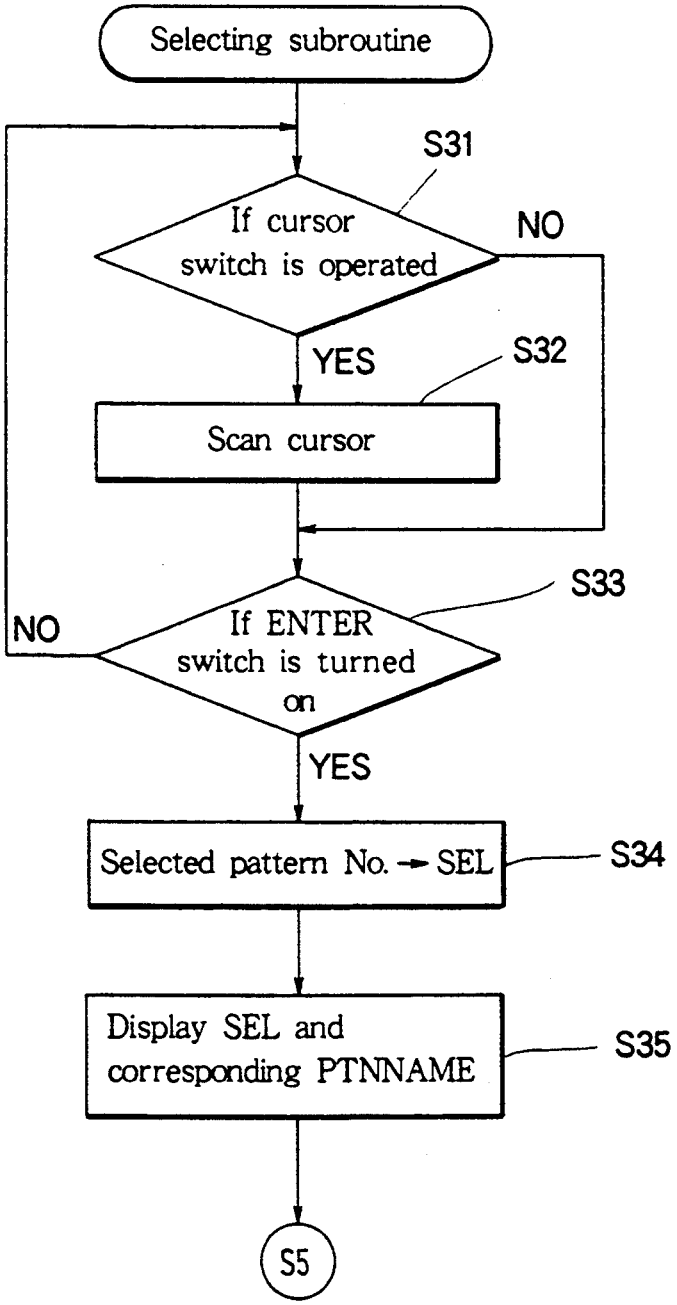
FIG. 6 is a flowchart showing a selecting subroutine.

Next, processing advances to the selecting subroutine. As shown in FIG. 6, this subroutine is executed to select one of the proposed patterns by moving a cursor line indicated on the display 21 by means of the cursor switch 22*b*. Firstly, Step S31 is undertaken to check as to if the cursor switch is actuated. In case that the check result shows YES, the displayed cursor is scanned in Step S32 until the enter switch 22*c* is actuated. Subsequent check is made in Step S33 as to if the enter switch 22*c* is turned on. In case that the check result shows YES, subsequent Step S34 is undertaken to select a pattern name PTNNAME marked by the cursor, and the pattern number PTN corresponding to the selected PTNNAME is identified as "selected pattern number SEL. Lastly in Step S35, the selected pattern number SEL and the corresponding pattern name PTNNAME are displayed on the display 21, for example, as shown in FIG. 7C.

Figure 8:
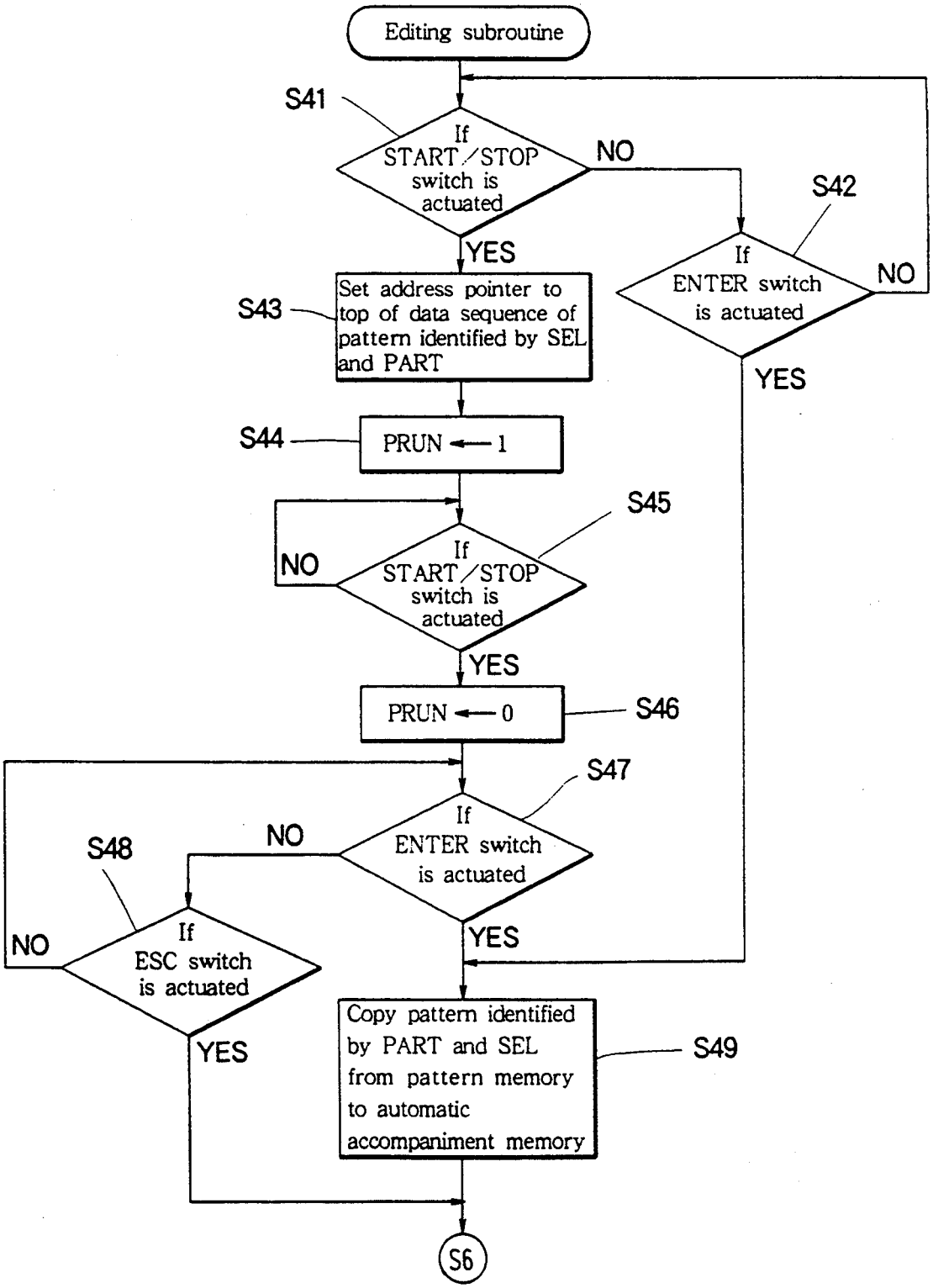
FIG. 8 is a flowchart showing an editing subroutine.

Next, the editing subroutine of FIG. 8 is executed to effect audition of the selected accompaniment pattern for evaluation of the same. First check is made in Step S41 as to if the START/STOP switch 22*e* is actuated, and second check is made in Step S42 as to if the ENTER switch 22*c* is actuated. Until either of the switches 22*e*, 22*c* is turned on, the CPU 7 is held in waiting state. When the START/STOP switch 22*e* is actuated, Step S43 is undertaken to set an address pointer to a top of data sequence of an accompaniment pattern which is identified by the selected pattern number SEL and the designated part number PART, and which is stored in the pattern memory 10*b*. Next, Step S44 is undertaken to set value "1" into a test flag PRUN which indicates audition state of the selected accompaniment pattern. Then, check is made in Step S45 when the START/STOP switch is actuated. Until the START/STOP switch is actuated, the CPU 7 is held in waiting state.

Figure 11:
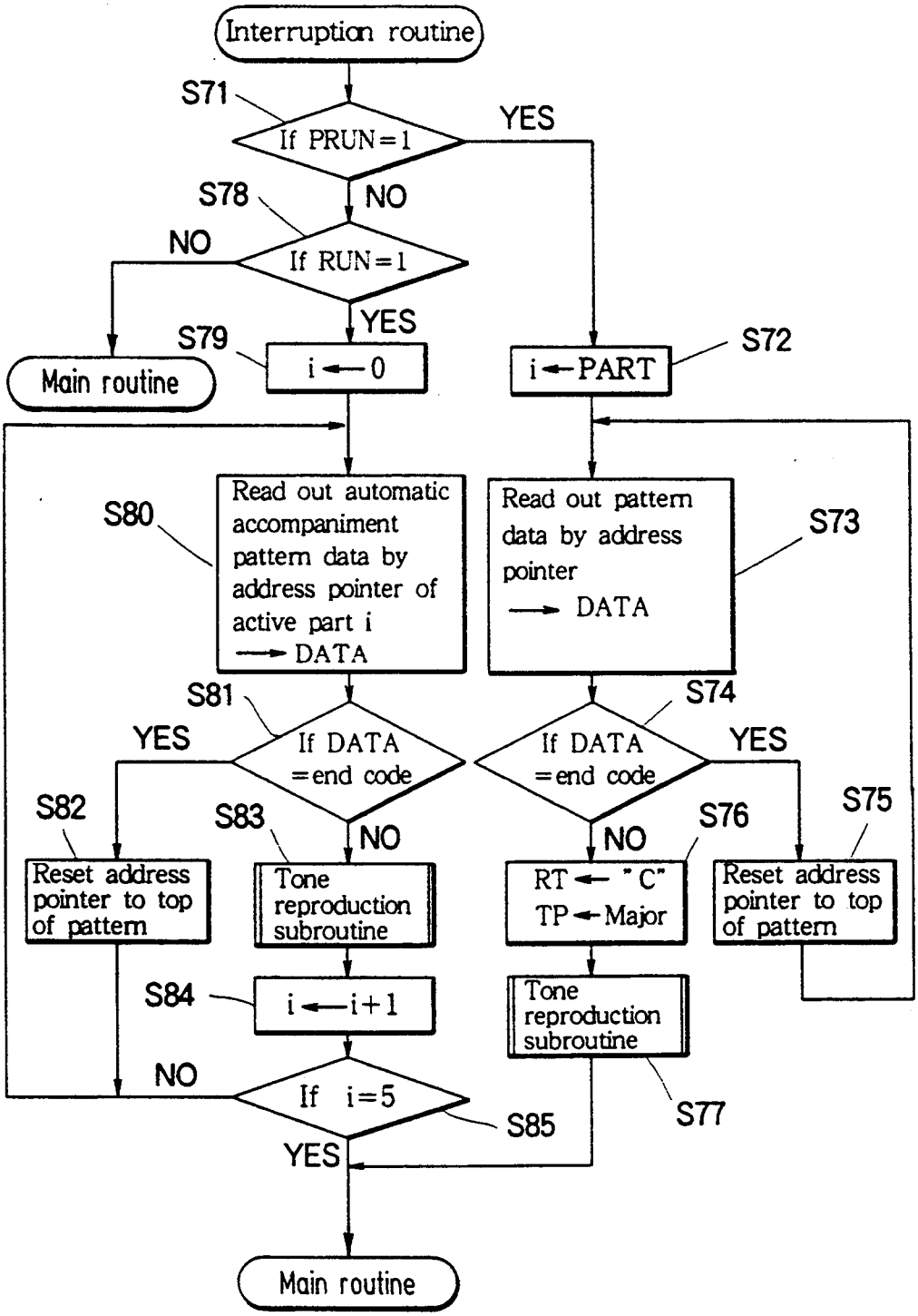
FIG. 11 is a flowchart showing an interruption routine.

During this waiting state, the interruption routine of FIG. 11 is called each 1/12 beat to carry out tone generation process of audition according to the pattern data stored in respective address designated by the address pointer during the audition. In this interruption routine, check is made in Step S71 as to if PRUN=1, and subsequent check is made in Step S78 as to if RUN=1 where RUN flag is set to value "1" during automatic accompaniment. In case of PRUN=0 and RUN=0, the interruption routine immediately returns to the main routine. In case that PRUN=1 is held in Step S71, processing proceeds to Step S72 where the designated part number PART is identified as an active part number i. In next Step S73, a pattern data designated by the address pointer is read out as an active data DATA. Then, check is made in Step S74 as to if the active data DATA indicates an end code. In case that this check result shows YES, the address pointer is reset to a top of the same pattern in Step S75, thereby returning to Step S73. On the other hand that the check result of Step S74 is held NO, Step S76 is undertaken to set a given note "C" into a root note register RT and to set a given type "Major" into a chord type register TP, thereby advancing to Step S77 where tone reproduction subroutine is executed.

Figure 12:
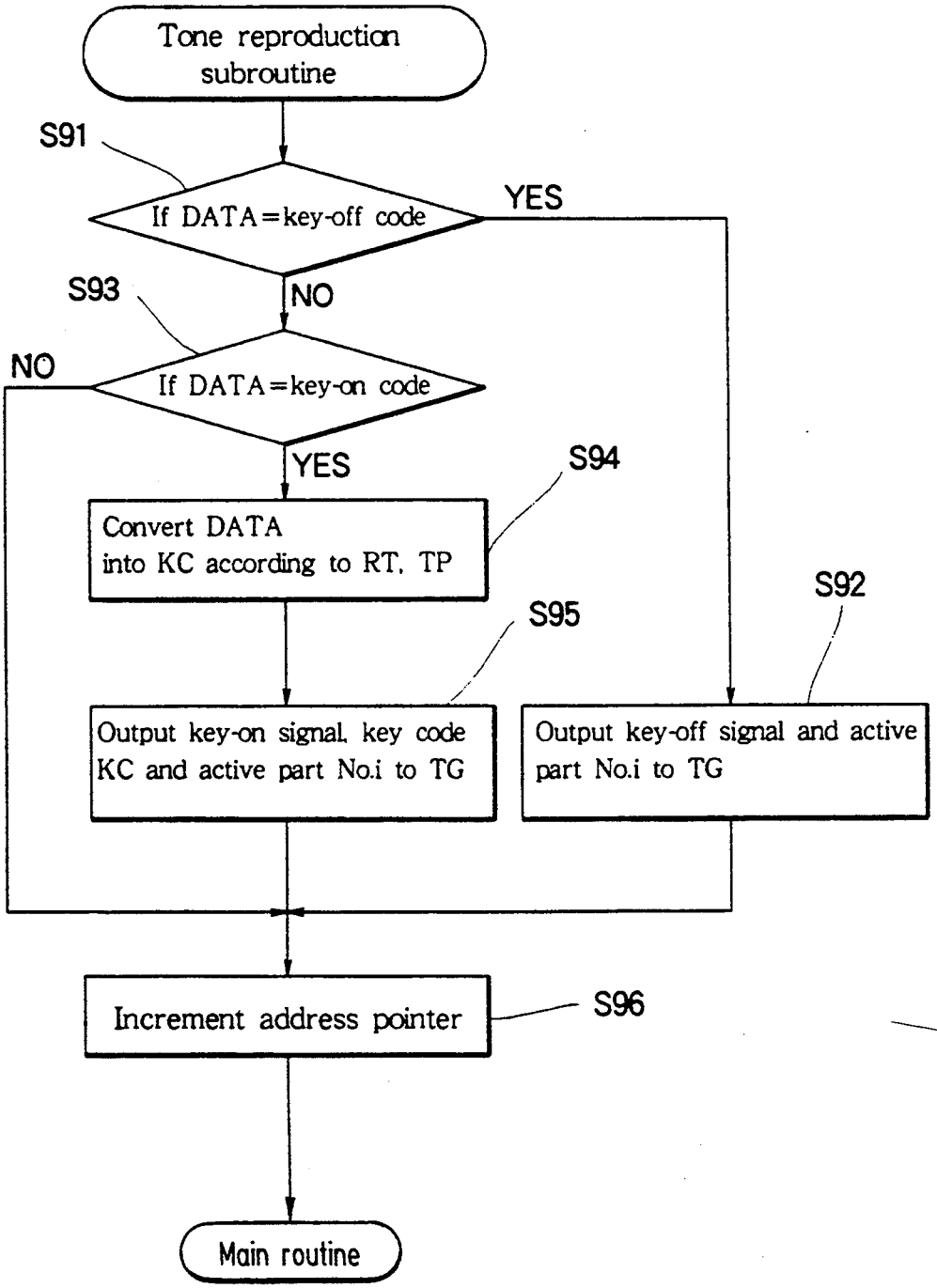
FIG. 12 is a flowchart showing a tone reproduction subroutine.

FIG. 12 shows the tone reproduction subroutine which is executed to feed to the tone generator 13, the active part number i and those of key-off/key-on signal and key code according to the active data DATA. First check is made in Step S91 as to if the active data DATA indicates a key-off code. In case that this check result shows YES, Step S92 is undertaken to output a key-off signal and the active part number i to the tone generator 13, and then Step S96 is undertaken to increment or update the address pointer, thereby finishing this subroutine. On the other hand that the check result of Step S91 is held NO, second check is made in Step S93 as to if the active data contains a key-on code. In case that this check result shows YES, subsequent Step S94 is undertaken to convert the active data into a tone pitch data, i.e., key code KC according to the chord root RT and chord type TP. Then, Step S95 is undertaken to output a key-on signal, key code KC and active part number i to the tone generator 13, thereafter advancing to Step S96. On the other hand that the check result of Step S93 is held NO, the active data DATA does not contain either of key-off code and key-on code, hence processing directly proceeds to Step S96. By this tone reproduction subroutine, the tone generator 13 receives various sound parameters such as key-on/key-off signal and key code according to the active data designated by the address pointer, thereby reproducing a musical tone of the selected accompaniment pattern of the active part for audition of the selected pattern.

Referring back to FIG. 8, as long as the START/STOP switch 22*e* is not actuated in Step S45, the interruption routine of FIG. 11 including tone reproduction subroutine of FIG. 12 is called every 1/12 beat, thereby reproducing the selected accompaniment pattern for audition. When the START/STOP switch 22*e* is activated, the test flag PRUN is reset to "0" in Step S46. Then, check is made in Step S47 as to if the ENTER switch 22*c* is actuated, and subsequent check is made in Step S48 as to if the ESC switch 22*d* is actuated. As long as the ENTER switch is not actuated, processing is held in waiting state. When the ESC switch 22*d* is actuated, this subroutine is immediately finished. When the ENTER switch 22*c* is actuated, Step S49 is undertaken to copy the accompaniment pattern identified by the selected pattern number SEL and by the designated part number PART, from the pattern memory 10*b* to a memory area of the automatic accompaniment memory 11, assigned to that part number PART, thereby finishing this subroutine. Alternatively when the ENTER switch 22*c* is actuated immediately after starting this subroutine in Step S42, processing jumps to Step S49. Accordingly in this subroutine, after or without the audition of the selected accompaniment pattern, the ENTER switch 22c is operated to confirm or fix the pattern selection. Then, data sequence of the fixed accompaniment pattern is transferred to the automatic accompaniment memory 11. As described above, the searching, selecting and editing subroutines (Step S3–S5 of FIG. 4) are sequentially executed so that a desired accompaniment pattern can be quickly and readily selected to satisfy the search condition which is inputted to represent desired characteristic features. Such a selecting operation can be effected for each of the part numbers "0"–"4" indicative of CHRD1, CHRD2, BASS, RYTHM1, RYTHM2, respectively, thereby editing accompaniment patterns for all the parts.

Figure 9:
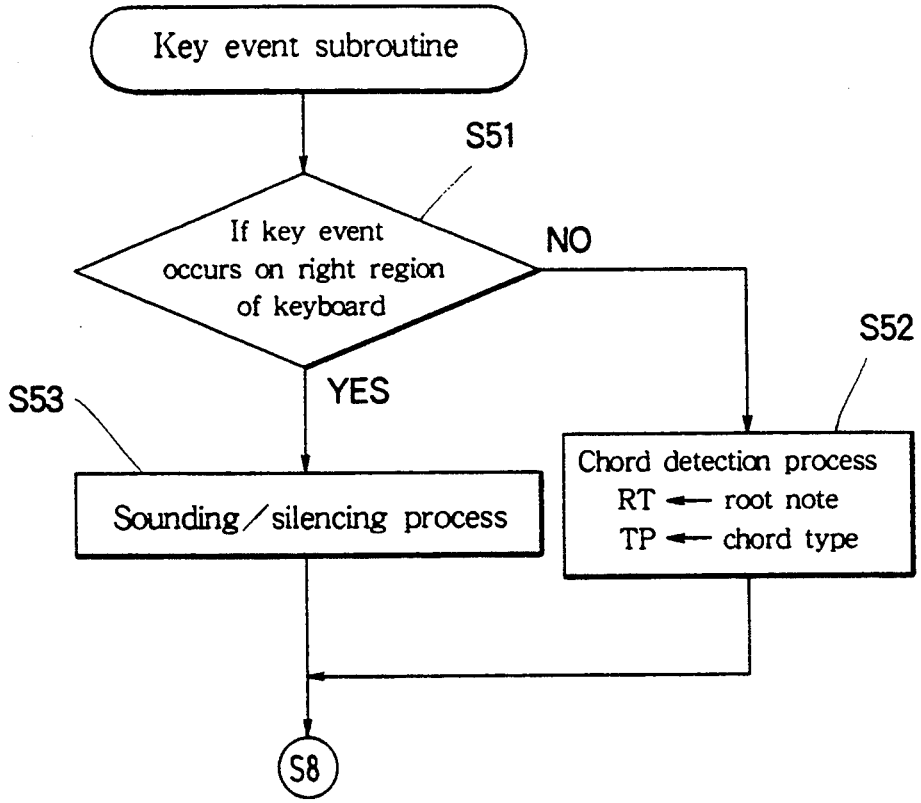
FIG. 9 is a flowchart showing a key event subroutine.

Referring to FIG. 9, detailed description is given for the key event subroutine executed in Step S7 of the FIG. 4 main routine. In this subroutine, check is made in Step S51 as to if key event (key depression/key release) belongs to a right region of the keyboard. In this embodiment, the keyboard is functionally split into the right and left regions. In case that the check result of Step S51 shows YES, Step S53 is undertaken to effect normal sounding/silencing process in response to the key operation on the right region. On the other hand that the key event occurs on the left region, Step S52 is undertaken to effect chord detection. A root note of the detected chord is set into RT and a type of the detected chord such as Major, Minor and Seventh is set into TP.

Figure 10:
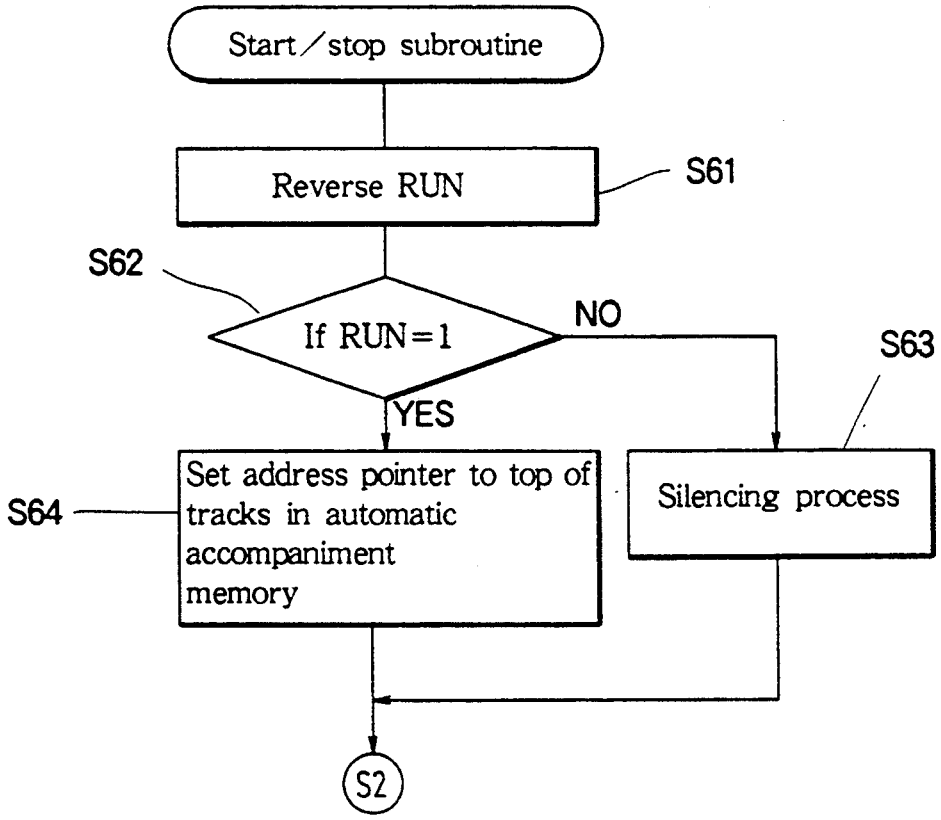
FIG. 10 is a flowchart showing a start/stop subroutine.

Next, referring to FIG. 10, the detailed description is given for the start/stop subroutine which is executed in Step S9 of the FIG. 4 main routine. In this subroutine, Step S61 is undertaken to reverse the automatic accompaniment flag RUN in response to the actuation of the START/STOP switch. Namely, the state RUN=0 is reversed to RUN=1, or the other state RUN=1 is reversed to RUN=0. Next, check is made as to if RUN=1 in Step S62. In case of RUN=0, the silencing process is carried out in Step S63. In case of RUN=1, Step S64 is undertaken to set the address pointer to a top of respective tracks which store accompaniment patterns of the respective parts in the automatic accompaniment memory 11. By this subroutine, when the START/STOP switch 22e is actuated during the course of the automatic accompaniment, the automatic accompaniment is terminated. On the other hand that the START/STOP switch 22e is actuated in waiting state, the automatic accompaniment is initiated.

Lastly, the automatic accompaniment performance is described in detail. During the course of the automatic accompaniment, a loop process is carried out in the sequence of Step S2→Step S6→Step S7→Step S8→Step S2 in the FIG. 4 main routine. During the loop process, the interruption routine of FIG. 11 is called every 1/12 beat so as to activate the tone generator 13 to produce accompaniment tones. Namely, in the interruption routine, since PRUN=0 and RUN=1 are held during the automatic accompaniment, check result of Step S71 is held NO, and check result of Step S78 is held YES so that Steps S79–S85 are effected. The active part number i is set to "0" in Step S79. Then, Step S80 is undertaken to read out from the automatic accompaniment memory 11, an automatic accompaniment pattern data which is addressed by the address pointer of the active part number i. The retrieved data is set as an active data DATA. Check is made in Step S81 as to if the active data DATA indicates an end code. In case that this check result shows YES, the address pointer is reset to a top of the accompaniment pattern in Step S82, thereafter returning to Step S80. On the other hand that the check result of Step S81 is found NO, the before-described tone reproduction subroutine of FIG. 12 is carried out in Step S83. Then, the active part number i is incremented by value "1" in Step S84. Lastly, Step S85 is undertaken to check as to if the active part number i reaches "5". The active part number i may take values "0"–"4" corresponding to CHRD1, CHRD2, BASS, RYTHM1 and RYTHM2. Therefore, Steps S80–S85 are repeatedly carried out until the active part number i exceeds "4", thereby finishing this subroutine. By this operation, the automatic accompaniment is effected in ensemble of all the parts. As described above, the Steps S6–S9 of the FIG. 4 main routine are executed to generate tones according to the selected accompaniment patterns in response to operation of the keyboard 1 and START/STOP switch 22e.

According to the present invention, desired characteristic features of an accompaniment pattern is inputted as a search condition so as to select a certain accompaniment pattern which meets the inputted search condition, thereby quickly and readily setting the automatic accompaniment. Further, desired accompaniment patterns can be selected by searching for respective accompaniment parts so as to form ensemble automatic accompaniment. The selected patterns are combined in a desired ensemble of the automatic accompaniment among vast number of possible combinations of accompaniment patterns, for example, 1,000,000 combinations in the FIG. 3 embodiment.

What is claimed is:

1. An automatic accompaniment apparatus comprising:

pattern memory means for storing a plurality of accompaniment patterns;

reference memory means for storing a plurality of characteristic references corresponding to respective accompaniment patterns, each of the plurality of characteristic references being representative of a characteristic feature of each corresponding accompaniment pattern;

input means for inputting a search condition representative of a desired characteristic feature;

searching means for searching the plurality of characteristic references stored in the reference memory means according to the inputted search condition to select from the pattern memory means a particular accompaniment pattern having the desired characteristic feature specified by the search condition; and performing means for automatically performing an accompaniment according to the selected accompaniment pattern.

2. An automatic accompaniment apparatus according to claim 1, further including audition means for conducting an audition of the selected accompaniment pattern to evaluate the selected accompaniment pattern prior to actual performance of the automatic accompaniment.

3. An automatic accompaniment apparatus according to claim 1, wherein the reference memory means has means for recording each of the plurality of characteristic references in the form of different terms representative of various aspects of the characteristic feature of the corresponding accompaniment pattern, and wherein the input means includes term input means for inputting the search condition in the form of a combination of proposed terms representing a desired characteristic feature.

4. An automatic accompaniment apparatus according to claim 3, wherein the term input means includes means for inputting a logical formula composed of a logical combination of the proposed terms.

5. An automatic accompaniment apparatus according to claim 1, further including designating means for designating each of multiple parts which constitute an ensemble accompaniment, and wherein the searching means includes means for selecting an accompaniment pattern for each designated part.

6. An automatic accompaniment apparatus according to claim 1, further including designating means, operable when the search means finds two or more accompaniment patterns in the pattern memory means having the same desired characteristic feature, for designating one of the accompaniment patterns to be performed.

7. An automatic accompaniment apparatus according to claim 6, further including display means for displaying the accompaniment patterns found by the searching means.

8. An automatic accompaniment apparatus comprising:

pattern memory means for storing a plurality of accompaniment patterns which are grouped into several parts;

reference memory means for storing a characteristic feature as a characteristic reference for each of the accompaniment patterns in corresponding manner;

designating means for selectively designating a respective one of the several parts;

input means for inputting a proposed characteristic feature as a search condition for each designated part;

searching means for searching the character reference stored in the reference memory means for each accompaniment pattern according to the inputted search condition to select a particular accompaniment pattern which satisfies the proposed characteristic feature; and performing means for reading out a set of the selected accompaniment patterns from the respective parts of the pattern memory means to effect an automatic accompaniment which is an ensemble of the selected accompaniment patterns.

9. A method of selecting an automatic accompaniment pattern to be played on an automatic accompaniment apparatus, the method comprising the steps of:

storing a plurality of accompaniment patterns;

storing a plurality of characteristic references corresponding to respective accompaniment patterns, each of the plurality of characteristic references being representative of a characteristic feature of each corresponding accompaniment pattern;

inputting a search condition representative of a desired characteristic feature;

searching the plurality of stored characteristic references according to the inputted search condition to select a particular accompaniment pattern having the desired characteristic feature specified by the search condition from the stored accompaniment patterns.

10. A method according to claim 9, further including the step of automatically performing an accompaniment according to the selected accompaniment pattern.

11. A method according to claim 9, further including the step of auditioning the selected accompaniment pattern to evaluate the selected accompaniment pattern prior to actual performance of the automatic accompaniment.

12. A method according to claim 9, wherein the step of storing the plurality of characteristic references includes storing each of the plurality of characteristic references in the form of different terms representative of various aspects of the characteristic feature of the corresponding accompaniment pattern, and wherein the step of inputting the search includes inputting the search condition in the form of a combination of proposed terms representing a desired characteristic feature.

13. A method according to claim 12, wherein the inputting the search further includes inputting a logical formula composed of a logical combination of the proposed terms.

14. A method according to claim 9, further including the steps of designating each of multiple parts which constitute an ensemble accompaniment, and selecting an accompaniment pattern for each designated part.

* * * * *